US010663117B2

(12) United States Patent
Chen et al.

(10) Patent No.: US 10,663,117 B2
(45) Date of Patent: May 26, 2020

(54) MULTIFUNCTIONAL LED BULB

(71) Applicant: Zhejiang Z-Light Optoelectronics Co., Ltd., ZheJiang (CN)

(72) Inventors: Guocai Chen, ZheJiang (CN); Jianwu Xue, ZheJiang (CN); Yiping Ye, ZheJiang (CN)

(73) Assignee: ZHEJIANG Z-LIGHT OPTOELECTRONICS CO., LTD, Zhejiang (CN)

( * ) Notice: Subject to any disclaimer, the term of this patent is extended or adjusted under 35 U.S.C. 154(b) by 37 days.

(21) Appl. No.: 15/971,180

(22) Filed: May 4, 2018

(65) Prior Publication Data

US 2019/0195431 A1 Jun. 27, 2019

(30) Foreign Application Priority Data

Dec. 25, 2017 (CN) ..... 2017 1 1419072

(51) Int. Cl.
*F21K 9/232* (2016.01)
*F21V 3/02* (2006.01)
(Continued)

(52) U.S. Cl.
CPC ..... *F21K 9/232* (2016.08); *F21K 9/238* (2016.08); *F21V 3/02* (2013.01); *F21V 23/006* (2013.01);
(Continued)

(58) Field of Classification Search
CPC . F21K 9/232; F21K 9/238; F21K 9/66; F21K 9/64; F21V 23/006; F21V 29/70;
(Continued)

(56) References Cited

U.S. PATENT DOCUMENTS

2012/0132931 A1* 5/2012 Inoue ..... H01L 33/486 257/88
2013/0058080 A1* 3/2013 Ge ..... F21V 3/00 362/231
2017/0063047 A1* 3/2017 Steigerwald ..... H01S 5/4093

FOREIGN PATENT DOCUMENTS

CN 103363332 A * 10/2013
CN 103363332 B 10/2013
(Continued)

OTHER PUBLICATIONS

Machine English Translation of WO2018/201643A1; Li (Year: 2018).*
Machine English Translation of CN103363332A; Li, W; 2013 (Year: 2013).*

*Primary Examiner* — Anh T Mai
*Assistant Examiner* — Glenn D Zimmerman
(74) *Attorney, Agent, or Firm* — Muncy, Geissler, Olds & Lowe, P.C.

(57) ABSTRACT

A multifunctional LED bulb includes a lamp base, a light-transmitting bulb shell, a driving power supply, electric lead wires, a stem, at least one LED light source and a support column, wherein the tail of the light-transmitting bulb shell is fixedly connected with the lamp base; the driving power supply is located in the lamp base, and the LED light sources and the support column are wrapped in an inner cavity of the light-transmitting bulb shell; the light-transmitting bulb shell is sealed by the lower portion of the stem which is of a hollow structure, an exhaust pipe is arranged in the stem, and a hole is formed in the joint of the upper end of the exhaust pipe and the stem. The multifunctional LED bulb looks like ordinary incandescent bulbs, and is environmentally friendly, good in heat dissipation and light-emitting effect.

11 Claims, 3 Drawing Sheets

(51) Int. Cl.

| | |
|---|---|
| ***F21V 29/70*** | (2015.01) |
| ***F21K 9/238*** | (2016.01) |
| ***F21V 23/00*** | (2015.01) |
| *F21V 3/06* | (2018.01) |
| *F21Y 115/10* | (2016.01) |
| *F21V 17/10* | (2006.01) |

(52) U.S. Cl.
CPC ..... *F21V 29/70* (2015.01); *F21V 3/061* (2018.02); *F21V 3/062* (2018.02); *F21V 17/10* (2013.01); *F21Y 2115/10* (2016.08)

(58) Field of Classification Search
CPC . F21V 3/02; F21V 3/061; F21V 17/10; F21V 3/062; F21V 23/06; F21V 19/0025; F21V 29/86; F21V 29/85; F21V 29/503; F21Y 2115/10
See application file for complete search history.

(56) References Cited

FOREIGN PATENT DOCUMENTS

WO WO-2013135153 A1 * 9/2013 ..... F21V 3/061
WO WO-2018201643 A1 * 11/2018

* cited by examiner

MULTIFUNCTIONAL LED BULB

CROSS-REFERENCE TO RELATED APPLICATION

The present application relies on, for priority, China Patent Application number 201711419072.X entitled "MULTIFUNCTIONAL LED BULB", filed on Dec. 25, 2017, which is also herein incorporated by reference in its entirety.

BACKGROUND OF THE INVENTION

1. Technical Field

This invention belongs to the technical field of bulbs, and particularly relates to a multifunctional LED bulb.

2. Description of Related Art

The application of LEDs to LED illumination is of the greatest importance and has the broadest development prospects. With the further maturity of LED techniques, the design of LED illuminating bulbs will become the mainstream of the design of room lamps in the 21st century, fully reflecting the energy-saving, healthy, artistic and user-friendly illumination development tendency, and become dominant in the aspect of room lamplight culture. LED bulbs adopt existing interface modes, namely the screw mode and the socket mode (E26\E27\E14\B22 standard interfaces and other interfaces), and even imitate incandescent bulbs in shape and size to accord with the using habits of users, and thus are extremely popular with users. Traditional bulbs are incandescent bulbs which are low in luminance and cannot emit bright light or save energy. The fluorescent bulbs which appeared after incandescent bulbs can save energy and emit bright light, but are not environmentally friendly enough due to the adoption of a large quantity of fluorescent powder. LED light sources which can save more energy and are more environmentally friendly are available at present, and accordingly LED bulbs are produced. However, existing LED bulbs are generally complex in structure and each one mainly comprises a lamp base, a neck and a light-emitting spherical surface, wherein the light-emitting spherical surface and the lamp base are standard parts, the neck is generally made of plastic or metal, and the neck is generally lightproof and is mainly used for connection and heat dissipation or used for storing an actuator. The light-emitting spherical surface is generally made of plastic or glass and is used for light transmission. Moreover, a heat dissipation device generally needs to be additionally arranged, generally can be seen from the outside and has a weird shape, and thus the shape and internal structure of existing LED bulbs are quite different from those of ordinary incandescent bulbs.

According to existing LED bulbs, LEDs generally emit light forwards, and due to the limitations of the light-emitting angles of the LEDs, a taper angle is formed when the existing LED bulbs emit light, and consequentially, the existing LED bulbs cannot emit light in all directions like traditional incandescent bulbs and fluorescent bulbs. After existing LED bulbs replace incandescent bulbs and fluorescent bulbs to be applied to lamps, the light-emitting effect of the LED bulbs is quite different from that of incandescent bulbs and fluorescent bulbs due to the difference in the aspect of the light-emitting mode, consequentially, the designed light-emitting effect of lamps cannot be achieved, the decorative performance is greatly reduced, and negative influences on bulb substitutes are caused. In addition, to meet the requirement for high brightness, existing LED bulbs have to be provided with a large number of LEDs. Since the internal space of the bulbs is small, in order to save space, the LEDs are generally arranged in staggered and overlapped modes, refraction and reflection are caused by mutual disturbance when the LEDs emit light, and consequentially, the light transmission performance and the light-emitting effect of existing LED bulbs are poor.

On account of the above problems, improvements on existing LED bulbs are necessary.

BRIEF SUMMARY OF THE INVENTION

To solve the above problems of the prior art, this invention aims to provide a multifunctional LED bulb which is good in light transmission performance and has the same light-emitting mode, size and shape as ordinary incandescent bulbs, and an LED bulb that is attractive in appearance, simple in structure, capable of saving energy, environmentally friendly, good in heat dissipation effect, capable of emitting light in all directions and good in light-emitting effect.

According to the technical scheme adopted by this invention for achieving the above aims: a multifunctional LED bulb comprises a lamp base and a light-transmitting bulb shell, and the tail of the light-transmitting bulb shell is fixedly connected with the lamp base. The LED bulb further comprises a driving power supply, electric lead wires, a stem, at least one LED light source and a support column, wherein the driving power supply is located in the lamp base, and the LED light sources and the support column are wrapped in an inner cavity of the light-transmitting bulb shell; the light-transmitting bulb shell is sealed by the lower portion of the stem, the stem is of a hollow structure, an exhaust pipe is arranged in the stem, and a hole is formed in the joint of the upper end of the exhaust pipe and the stem; the support column is fixedly arranged on the stem, and the support column and the stem are formed integrally; the at least one LED light source is at least one LED light-emitting strip fixed to the support column; electrode lead wires at the two ends of each LED light-emitting strip are connected with the driving power supply through the electric lead wires.

As a preferred scheme of the invention, an upper positioning piece and a lower positioning piece which are used for positioning the two ends of each LED light-emitting strip are separately arranged at the upper end and the lower end of the support column; the multiple LED light-emitting strips are evenly distributed on the upper positioning piece and the lower positioning piece; the two ends of each LED light-emitting strip are provided with an upper conductive metal wire and a lower conductive metal wire and are connected with the upper positioning piece and the lower positioning piece through the upper conductive metal wire and the lower conductive metal wire separately; after the two ends of each of the multiple LED light-emitting strips are welded and fixed to an upper fixing ring and a lower fixing ring, a conical LED light-emitting strip assembly is formed, and the multiple LED light-emitting strips emit light all around with all circumferential surfaces of the light-transmitting bulb shell as reference surfaces.

As a preferred scheme of the invention, the LED light-emitting strip assembly is located at the light-emitting center of the light-transmitting bulb shell.

As a preferred scheme of the invention, the LED bulb further comprises polytetrafluoroethylene sleeves, wherein the electric lead wires connected to the LED light-emitting strips penetrate through the polytetrafluoroethylene sleeves to be connected with the driving power supply.

As a preferred scheme of the invention, the light-transmitting bulb shell is filled with high-thermal-conductivity and low-viscosity gas, heat generated when the LED light-emitting strips operate is dissipated through conduction and convection by the gas and then through the light-transmitting bulb shell, the gas is helium, or a mixed gas of helium and nitrogen, or pure air, and the gas pressure at room temperature is 50-1520 Torr.

As a preferred scheme of the invention, each LED light-emitting strip comprises a non-transparent heat dissipation substrate, wherein the non-transparent heat dissipation substrate is made of white ceramic, a plurality of LED chips are mounted on the white ceramic and fixedly arranged on one side face of the white ceramic, and the multiple LED chips are combined to emit light within 360 degrees; the LED light-emitting strips are connected to form a one-way DC to operate.

As a preferred scheme of the invention, the non-transparent heat dissipation substrates are made of graphite.

As a preferred scheme of the invention, the light-transmitting bulb shell is made of crystals, quartz, plastic or glass.

As a preferred scheme of the invention, an insulating bushing is arranged at the joint of the lamp base and the light-transmitting bulb shell; the driving power supply is connected into the insulating bushing in a sleeved mode, the insulating bushing is arranged in the lamp base, and the space between the lamp base and the light-transmitting bulb shell is filled with incandescent lamp paste.

As a preferred scheme of the invention, a conductive rivet is inserted into the outer portion of the top end of the lamp base and is of a non-welded conductive rivet structure or a welded thin E27 copper-cast lamp base structure.

Beneficial Effects of the Invention

1. The multifunctional LED bulbs of the invention are good in light transmission performance, have the same light-emitting mode, size and shape as ordinary incandescent bulbs, and are attractive in appearance, simple in structure, capable of saving energy, environmentally friendly, good in heat dissipation effect, capable of emitting light in all directions, and good in light-emitting effect.

2. The whole multifunctional LED bulb of the invention has the advantages of being high in efficiency, low in cost, long in life, safe, reliable and the like, and can be used for illumination in places such as homes, offices and shopping malls.

Marks in the FIGS.: 1, lamp base; 2, light-transmitting bulb shell; 3, driving power supply; 4, stem; 5, support column; 6, LED light-emitting strip; 7, electric lead wire; 8, upper positioning piece; 9, lower positioning piece; 10, upper conductive metal wire; 11, lower conductive metal wire; 12, exhaust pipe; 13, non-transparent heat dissipation substrate; 14, LED chip; 15, insulating bushing; 16, incandescent lamp paste; 17, conductive rivet; 18, polytetrafluoroethylene sleeve; 19, hole; 20, heat dissipation layer.

DETAILED DESCRIPTION OF THE INVENTION

A detailed description of the embodiments of the invention is given with accompanying drawings as follows.

First Embodiment

Figure 1:
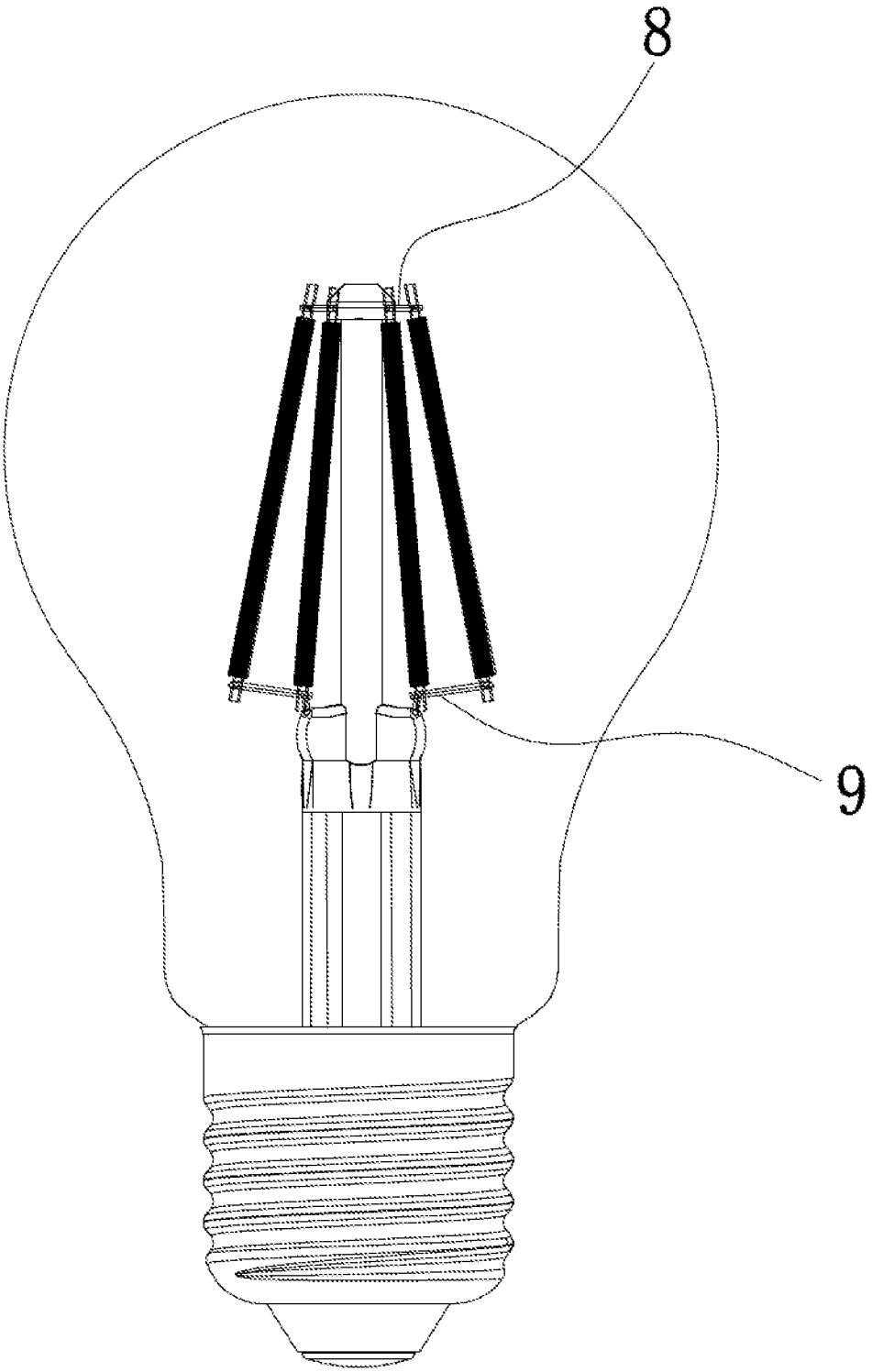
FIG. 1 is a structural diagram of an embodiment of the invention.
Figure 2:
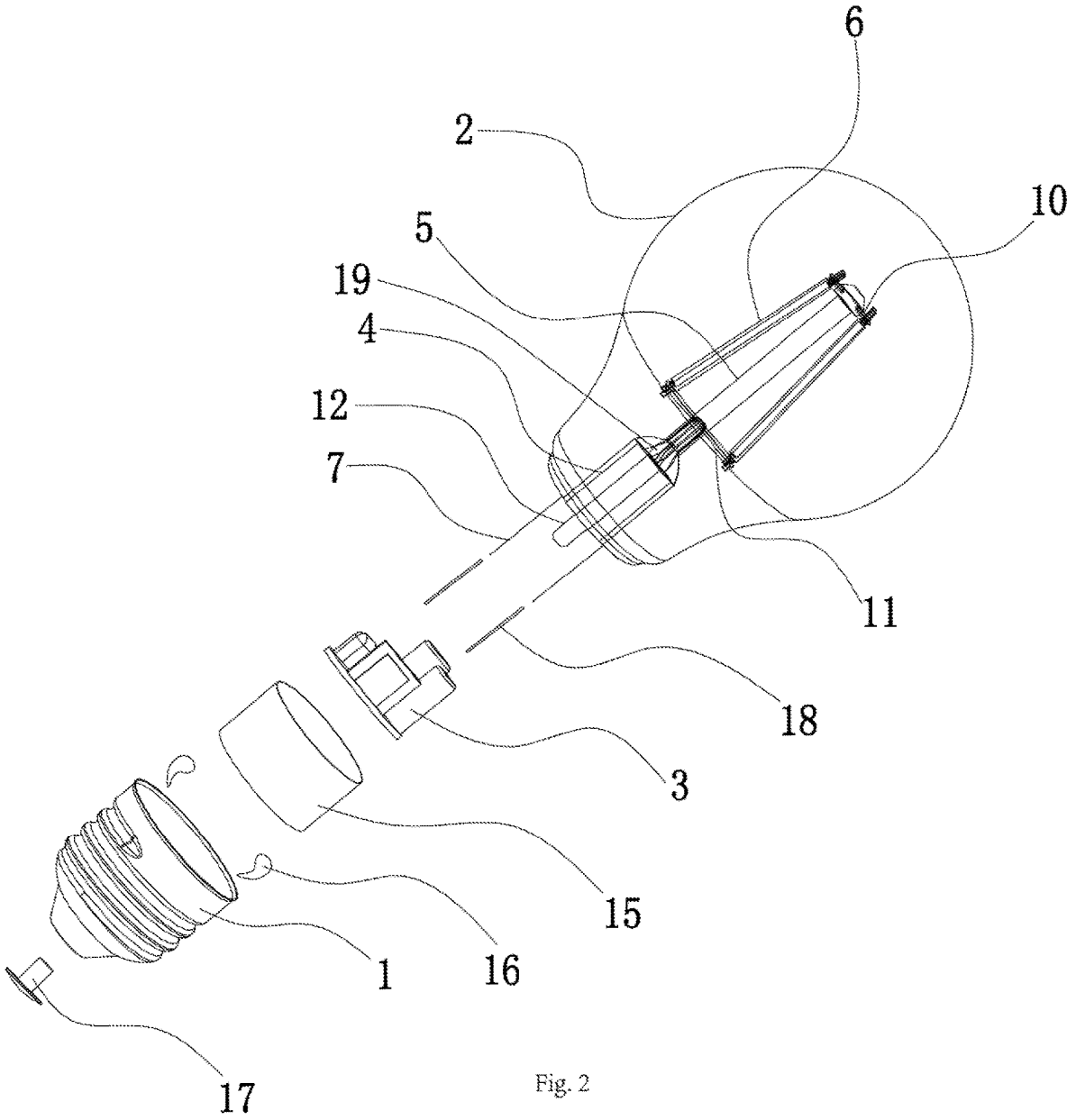
FIG. 2 is an exploded view of the embodiment of the invention.

As is shown in FIG. 1 and FIG. 2, a multifunctional LED bulb comprises a lamp base 1 and a light-transmitting bulb shell 2, and the tail of the light-transmitting bulb shell 2 is fixedly connected with the lamp base 1. The multifunctional LED bulb is characterized by further comprising a driving power supply 3, electric lead wires 7, a stem 4, at least one LED light source and a support column 5, wherein the driving power supply 3 is located in the lamp base 1, and the LED light sources and the support column 5 are wrapped in an inner cavity of the light-transmitting bulb shell 2; the stem 4 is of a hollow structure, an exhaust pipe 12 is arranged in the stem 4, and a hole 19 is formed in the joint of the upper end of the exhaust pipe 12 and the stem 4; the hole 19 is located on the stem 4, actually, the exhaust pipe 12 is also of a hollow structure, and the light-transmitting bulb shell 2 is sealed by the lower portion of the stem 4; the stem 4 connected with the exhaust pipe 12 is welded on the light-transmitting bulb shell 2 firstly, then gas is the light-transmitting bulb shell 2 is completely exhausted through the exhaust pipe 12, helium, or a mixed gas of helium and nitrogen, or pure air is injected into the light-transmitting bulb shell 2 through the exhaust pipe 12, and the lower portion of the exhaust pipe 12 is sealed after gas is injected into the light-transmitting bulb shell 2; the light-transmitting bulb shell 2 is filled with high-thermal-conductivity and low-viscosity gas, heat generated when LED light-emitting strips 6 operate is dissipated through conduction and convection by the gas and then through the light-transmitting bulb shell 2, the gas is helium, or the mixed gas of helium and nitrogen, or pure air, and the gas pressure at room temperature is 50-1520 Torr; helium injected into the light-transmitting bulb shell 2 is high-thermal-conductivity and low-viscosity gas, so that heat generated when the LED light-transmitting strips 6 operate can be dissipated through heat conduction and convection by the gas and then through the light-transmitting bulb shell 2.

The support column 5 is fixedly arranged on the stem 4, and the support column 5 and the stem 4 are formed integrally; the at least one LED light source is at least one LED light-transmitting strip 6 fixed to the support column 5; electrode lead wires at the two ends of each LED light-transmitting strip 6 are connected with the driving power supply 3 through the electric lead wires 7.

An upper positioning piece 8 and a lower positioning piece 9 used for positioning the two ends of each LED light-transmitting strip 6 are separately arranged at the upper end and the lower end of the support column 5; the multiple LED light-transmitting strips 6 are evenly distributed on the upper positioning piece 8 and the lower positioning piece 9 and can be arranged on the inner side or the outer side of the upper positioning piece 8 and the lower positioning piece 9; the two ends of each LED light-transmitting strip 6 are separately provided with an upper conductive metal wire 10 and a lower conductive metal wire 11 and connected with the upper positioning piece 8 and the lower positioning piece 9 through the upper conductive metal wire 10 and the lower conductive metal wire 11 respectively, and the diameter of the upper positioning piece 8 can be greater or smaller than that of the lower positioning piece 9 and can also be equal to that of the lower positioning piece 9; after the two ends of each of the multiple LED light-transmitting strips 6 are welded and fixed to an upper fixing ring and a lower fixing ring, a conical LED light-emitting strip assembly is formed, and the multiple LED light-transmitting strips 6 emit light all around with all circumferential surfaces of the light-transmitting bulb shell 2 as reference surfaces. When the LED light-emitting strips 6 are manufactured, the upper conductive metal wire 10 and the lower conductive metal wire 11 located at the two ends of each LED light-emitting strip 6 are fixedly connected with the upper positioning piece 8 and the lower positioning piece 9 through a professional spot welding device or an automatic welding device, and then the conical LED light-emitting strip assembly is manufactured; the manufactured LED light-emitting strips 6 have a fixed shape and thus can be fixed and welded conveniently; the technological process for fixing and welding the LED light-transmitting strips 6 is simple, the production cost can be effectively reduced, and the LED light-emitting strips 6 are suitable for volume production and are long in service life; meanwhile, the LED light-emitting strips 6 emit light within 360 degrees in the circumferential direction so that the designed light-emitting effect of the lamps can be completely achieved, and the decorative performance is good; in addition, the LED light-emitting strips 6 are evenly distributed on the outer side of the upper positioning piece 8 and the outer side of the lower positioning piece 9, and the LED light-emitting strip assembly is located at the light-emitting center of the light-transmitting bulb shell 2, so that the light-emitting paths of the LED light-emitting strips 6 are prevented from overlapping, refraction and reflection caused by mutual disturbance when the light-emitting strips 6 emit light are avoided, the light transmission performance is improved, and the light-emitting effect is good.

The LED bulb further comprises polytetrafluoroethylene sleeves 18, and the electric lead wires 7 connected to the LED light-emitting strips 6 penetrate through the polytetrafluoroethylene sleeves 18 to be connected with the driving power supply 3; the polytetrafluoroethylene sleeves 18 are arranged and connected to all lamp filaments of the LED light-emitting strips 6 in a sleeving mode, so that short circuits caused by contact of the positive electrodes and the negative electrodes of the lamp filaments are prevented, and safety during use is ensured.

The light-transmitting bulb shell 2 is made of crystals, quartz, plastic (acrylic PC) or glass; in the invention, the light-transmitting bulb shell 2 is preferably made of glass so that a cooling effect can be achieved when helium is injected into the light-transmitting bulb shell 2, and thermal expansion and cold contraction of other components in the light-transmitting bulb shell 2 are avoided, the integrity of the gas injected into the light-transmitting bulb shell 2 is ensured, and the utilization rate of the light sources and the light transmission rate are increased.

An insulating bushing 15 is arranged at the joint of the lamp base 1 and the light-transmitting bulb shell 2; the driving power supply 3 is connected into the insulating bushing 15 in a sleeved mode, the insulating bushing 15 is arranged in the lamp base 1, and the space between the lamp base 1 and the light-transmitting bulb shell 2 is filled with incandescent lamp paste 16; a conductive rivet 17 is inserted into the outer portion of the top end of the lamp base 1, and the conductive rivet 17 is of a non-welded conductive rivet structure or a welded thin E27 copper-cast lamp base structure.

Figure 3:
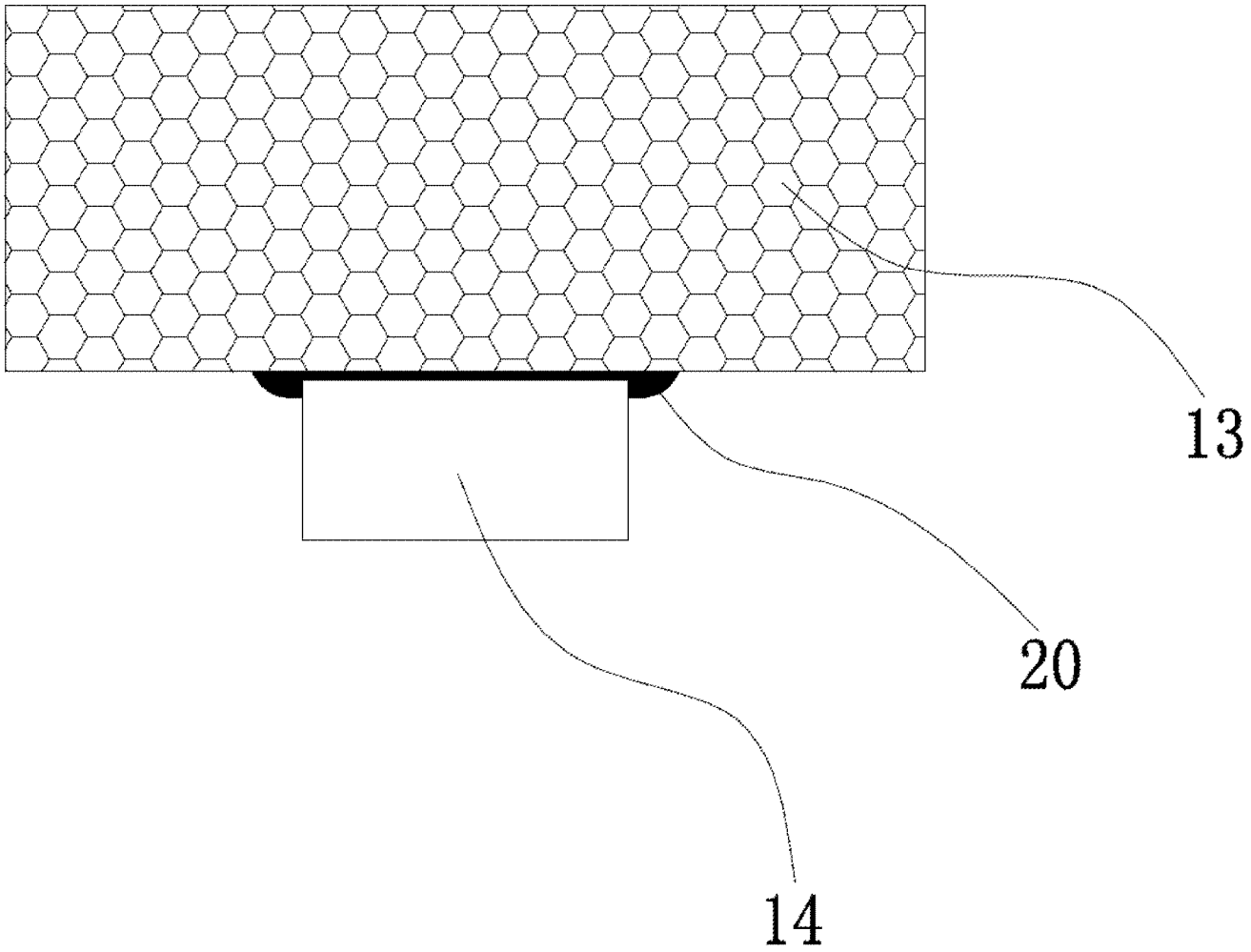
FIG. 3 is a structural diagram of an LED light-emitting strip in the embodiment of the invention.

As is shown in FIG. 3, each LED light-emitting strip 6 comprises a non-transparent heat dissipation substrate 13, wherein LED chips 14 are mounted on the non-transparent heat dissipation substrate 13 and fixedly arranged on one side face of the heat dissipation substrate 13, a heat dissipation layer 20 is arranged between the LED chips 14 and the heat dissipation substrate 13 and made of a mixture of transparent rubber and fluorescent powder, so that it is ensured that the light output by the LED chips from the edge areas of the two side surfaces of the non-transparent heat-dissipation substrate 13 is white light, and accordingly it is ensured that the LED light-emitting strips 6 can uniformly output white light in all directions. The multiple LED chips are combined to emit light within 360 degrees; the LED light-emitting strips can be connected to form a one-way DC to operate; when the LED strips 6 are connected to form a one-way DC to operate, an external power supply for the LED light-emitting strips 6 can be a DC power supply or an AC power supply; when an external AC power supply is in use, the driving power supply 3 can be composed of a current limiting circuit formed by a capacitor and a resistor in parallel connection, and a rectification filter circuit, and can also be composed of a switching power supply without a transformer, and a constant current device.

The non-transparent heat dissipation substrates 13 are made of white ceramic or graphite; as the sides, not fixed to the LED chips 14, of the non-transparent heat dissipation substrates 14 can be coated with one side of graphite, the non-transparent heat dissipation substrates 13 are preferably made of graphite in the embodiment; in the scheme, as the surface of the graphite is uneven, the superficial area is enlarged, and thus heat dissipation is enhanced; meanwhile, as the surface of the graphite is uneven, the situation where part of the light emitted by the LED chips 14 is directly output from the edge areas of the two side surfaces of each of the non-transparent heat dissipation substrates 13 can be prevented, and thus the heat dissipation efficiency of the LED light-emitting strips 6 is further improved while it is ensured that the LED light-emitting strips 6 can uniformly output light in all directions.

In the invention, the LED light sources are used to replace tungsten filaments of traditional incandescent bulbs, the support column 5 is used to replace tungsten filament supports of traditional incandescent bulbs, and meanwhile, each LED light-emitting strip 6 comprises one non-transparent heat dissipation substrate 13 serving as a heat dissipation device of the LED bulb, so that the appearance of the LED bulb is more attractive, the size and shape of the multifunctional LED bulbs of the invention are completely identical with those of ordinary incandescent bulbs, and the internal structure of the multifunctional LED bulbs of the invention is also basically identical with that of ordinary incandescent bulbs when seen from the outside. The multiple LED light-emitting strips 6 emit light all around with all circumferential surfaces of the light-transmitting bulb shell 2 as reference surfaces so that the multifunctional LED bulbs of the invention can emit light within 360 degrees in the circumferential direction like traditional incandescent bulbs, the designed light-emitting effect of lamps can be completely achieved, the decorative performance is good, and accordingly the multifunctional LED bulbs can replace incandescent bulbs and fluorescent bulbs; in addition, each LED chip 14 of the invention is provided with one non-transparent heat dissipation substrate 13, so that overlapping of the light-emitting paths of the LED chips is avoided, refraction and reflection caused by mutual disturbance when the LED chips emit light are avoided, accordingly, the light transmission performance is improved, and the light-emitting effect is good. Furthermore, the light-emitting principle of the LED bulbs of the invention is different from that of incandescent bulbs, the LED light sources can emit light without a vacuum environment, and thus the structure is simple; even if the bulb shell is broken, the LED light sources can still emit light without being affected, the bulb does not need to be scrapped, the LED chips have the advantages of energy saving and environmental friendliness, and little heat is generated.

According to the invention, heat can be dissipated through the non-transparent heat dissipation substrates 13 and air in the light-transmitting bulb shell 2, so that the LED bulbs of the invention have a low temperature and are not as hot as traditional incandescent bulbs; the LED bulbs of the invention can completely replace traditional incandescent bulbs and have an energy saving effect, the luminous efficiency of the LED bulbs is high, the LED bulbs with a power of 5 W can achieve the brightness of traditional incandescent lamp bulbs with a power of 60 W, and the life of the LED bulbs is long; the life of the LED bulbs of the invention can reach 30,000 hours or more, however, the life of traditional incandescent bulbs is only 1000 hours; in conclusion, the multifunctional LED bulbs of the invention is good in heat transmission performance, has the same light-emitting mode, size and shape as ordinary incandescent bulbs, is attractive in appearance, simple in structure, capable of saving energy, environmentally friendly, good in heat dissipation effect, capable of emitting light in all directions and good in light-emitting effect, and can completely replace incandescent bulbs.

Second Embodiment

The exhaust pipe 12 is also of a solid structure, one end of the exhaust pipe 12 is connected with the driving power supply 3, the other end of the exhaust pipe 12 is connected with the stem 4 and used for positioning the support column 5 on the stem 4, and thus only air is injected into the light-transmitting bulb shell 2.

The first embodiment can be taken as the reference for other content of the second embodiment.

Based on the above description of the disclosed embodiments, those professionally skilled in the field can implement or use the invention. Various modifications of these embodiments can be easily obtained by those professionally skilled in the field, and the general principle defined in the description can be implemented through other embodiments without deviating from the spirit or scope of the invention; therefore, the invention is not limited to these embodiments illustrated in the above description, and the invention has the widest scope according with the principle and novel characteristics in the description.

Although the terms including lamp base 1, light-transmitting bulb shell 2, driving power supply 3, stem 4, support column 5, LED light-emitting strip 6, electric lead wire 7, upper positioning piece 8, lower positioning piece 9, upper conductive metal wire 10, lower conductive metal wire 11, exhaust pipe 12, non-transparent heat dissipation substrate 13, LED chip 14, insulating bushing 15, incandescent lamp paste 16, conductive rivet 17, polytetrafluoroethylene sleeve 18, hole 19, and heat dissipation layer 20 marked in the FIGS. are adopted, it does not exclude the probability of the use of other terms; these terms are only used for conveniently describing and explaining the essence of the invention, and any interpretation of the terms as additional limitations goes against the spirit of the invention.

What is claimed is:

1. A multifunctional LED bulb, comprising a lamp base (1) and a light-transmitting bulb shell (2), wherein the tail of the light-transmitting bulb shell (2) is fixedly connected with the lamp base (1); wherein the LED bulb further comprises a driving power supply (3), electric lead wires (7), a stem (4), at least one LED light source and a support column (5); the driving power supply (3) is located in the lamp base (1), and the at least one LED light source and the support column (5) are wrapped in an inner cavity of the light-transmitting bulb shell (2); the light-transmitting bulb shell (2) is sealed by the lower portion of the stem (4), the stem (4) is of a hollow structure, an exhaust pipe (12) is arranged in the stem (4), and a hole (19) is formed in the joint of the upper end of the exhaust pipe (12) and the stem (4); the support column (5) is fixedly arranged on the stem (4), and the support column (5) and the stem (4) are formed integrally; the at least one LED light source is at least one LED light-emitting strip (6) fixed to the support column (5); electrode lead wires at the two ends of each LED light-emitting strip (6) are connected with the driving power supply (3) through the electric lead wires (7); wherein the electric lead wires (7) connected to the LED light-emitting strips (6) penetrate through polytetrafluoroethylene sleeves (18) to be connected with the driving power supply (3).

2. The multifunctional LED bulb according to claim 1, wherein an upper positioning piece (8) and a lower positioning piece (9) which are used for positioning the two ends of each LED light-emitting strip (6) are separately arranged at the upper end and the lower end of the support column (5); the multiple LED light-emitting strips (6) are evenly distributed on the upper positioning piece (8) and the lower positioning piece (9); the two ends of each LED light-emitting strip (6) are provided with an upper conductive metal wire (10) and a lower conductive metal wire (11) and are connected with the upper positioning piece (8) and the lower positioning piece (9) through the upper conductive metal wire (10) and the lower conductive metal wire (11) separately; and the multiple LED light-emitting strips (6) emit light around all circumferential surfaces of the light-transmitting bulb shell (2) as reference surfaces.

3. The multifunctional LED bulb according to claim 1, wherein the light-transmitting bulb shell (2) is filled with high-thermal-conductivity and low-viscosity gas, heat generated when the LED light-emitting strips (6) operate is dissipated through conduction and convection by the gas and then through the light-transmitting bulb shell (2), the gas is helium, or the mixed gas of helium and nitrogen, or pure air, and the gas pressure at the room temperature is 50-1520 Torr.

4. The multifunctional LED bulb according to claim 1, wherein each LED light-emitting strip (6) comprises a non-transparent heat dissipation substrate (13), wherein the non-transparent heat dissipation substrate (13) is made of white ceramic, a plurality of LED chips (14) are mounted on the white ceramic and fixedly arranged on one side face of the white ceramic, and the multiple LED chips are combined to emit light within 360 degrees; the LED light-emitting strips (6) are connected to form one-way DC to operate.

5. The multifunctional LED bulb according to claim 1, wherein each LED light-emitting strip (6) comprises a non-transparent heat dissipation substrate (13), wherein the non-transparent heat dissipation substrate (13) is made of graphite, a plurality of LED chips (14) are mounted on the graphite and fixedly arranged on one side face of the graphite, and the multiple LED chips are combined to emit light within 360 degrees; the LED light-emitting strips (6) are connected to form one-way DC to operate.

6. The multifunctional LED bulb according to claim 1, wherein the light-transmitting bulb shell (2) is made of crystals, quartz, plastic or glass.

7. The multifunctional LED bulb according to claim 2, wherein a LED light-emitting strip assembly is located at the light-emitting center of the light-transmitting bulb shell (2).

8. The multifunctional LED bulb according to claim 2, wherein the light-transmitting bulb shell (2) is filled with high-thermal-conductivity and low-viscosity gas, heat generated when the LED light-emitting strips (6) operate is dissipated through conduction and convection by the gas and then through the light-transmitting bulb shell (2), the gas is helium, or the mixed gas of helium and nitrogen, or pure air, and the gas pressure at the room temperature is 50-1520 Torr.

9. The multifunctional LED bulb according to claim 2, wherein each LED light-emitting strip (6) comprises a non-transparent heat dissipation substrate (13), wherein the non-transparent heat dissipation substrate (13) is made of white ceramic, a plurality of LED chips (14) are mounted on the white ceramic and fixedly arranged on one side face of the white ceramic, and the multiple LED chips are combined to emit light within 360 degrees; the LED light-emitting strips (6) are connected to form one-way DC to operate.

10. The multifunctional LED bulb according to claim 2, wherein each LED light-emitting strip (6) comprises a non-transparent heat dissipation substrate (13), wherein the non-transparent heat dissipation substrates (13) is made of graphite, a plurality of LED chips (14) are mounted on the graphite and fixedly arranged on one side face of the graphite, and the multiple LED chips are combined to emit light within 360 degrees; the LED light-emitting strips (6) are connected to form one-way DC to operate.

11. The multifunctional LED bulb according to claim 2, wherein the light-transmitting bulb shell (2) is made of crystals, quartz, plastic or glass.

* * * * *